United States Patent [19]

Schaming

[11] 4,387,739

[45] Jun. 14, 1983

[54] VALVE MODULE FOR DIGITAL COOLANT CONTROL SYSTEM

[76] Inventor: Edward J. Schaming, P.O. Box 1070, Butler, Pa. 16001

[21] Appl. No.: 304,674

[22] Filed: Sep. 22, 1981

[51] Int. Cl.[3] ..... B05B 1/16

[52] U.S. Cl. ..... 137/884; 251/129; 239/391; 239/551

[58] Field of Search ..... 137/884, 624.11; 251/129; 239/391, 551, 556, 557, 562

[56] References Cited

U.S. PATENT DOCUMENTS 3,785,389 1/1974 Friedland ..... 137/884 X 4,095,864 6/1978 Hardin ..... 137/884 X

*Primary Examiner*—Alan Cohan

*Attorney, Agent, or Firm*—D. Paul Weaver

[57] ABSTRACT

To facilitate manufacture and field maintenance of an electrical liquid coolant valve module, hard wiring is eliminated from the valve head and is replaced by a printed circuit card engaged by spring contact probes removably held in each replaceable solenoid unit of the module. A magnetic-non magnetic control poppet for each solenoid unit eliminates a dynamic seal for the poppet resulting in a very fast response time and better shut-off characteristics. System fluid pressure assists in closing the magnetic-non magnetic poppet. A replaceable poppet seat is made easily removable with a seat retainer which in turn enables removal of the two component poppet. The head of the valve module need not be separated from the coolant header when servicing solenoids and/or poppet seats, thus reducing the likelihood of starting leaks in the system.

12 Claims, 12 Drawing Figures

FIG.7
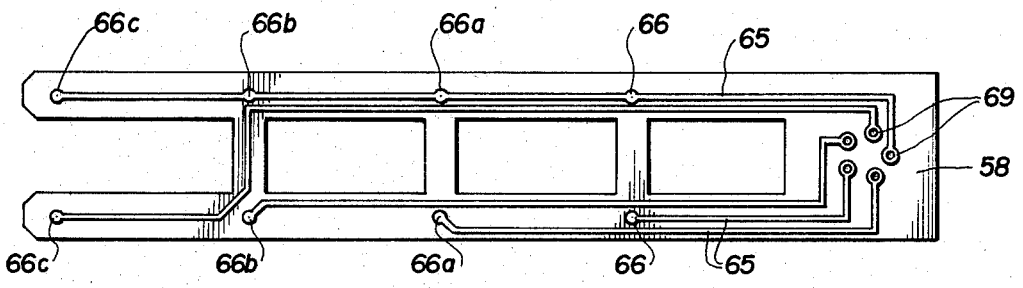
FIG.8
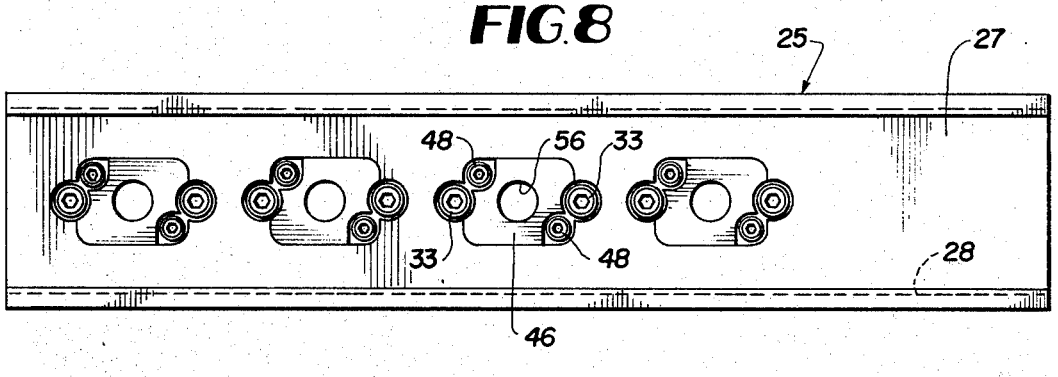
FIG.9
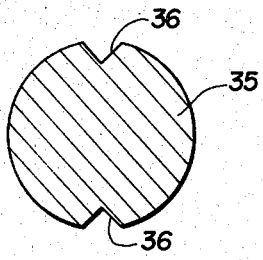
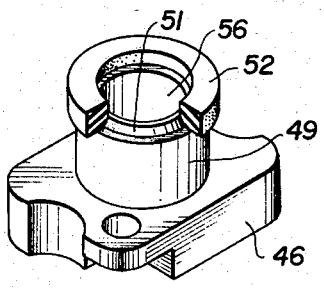
FIG.10
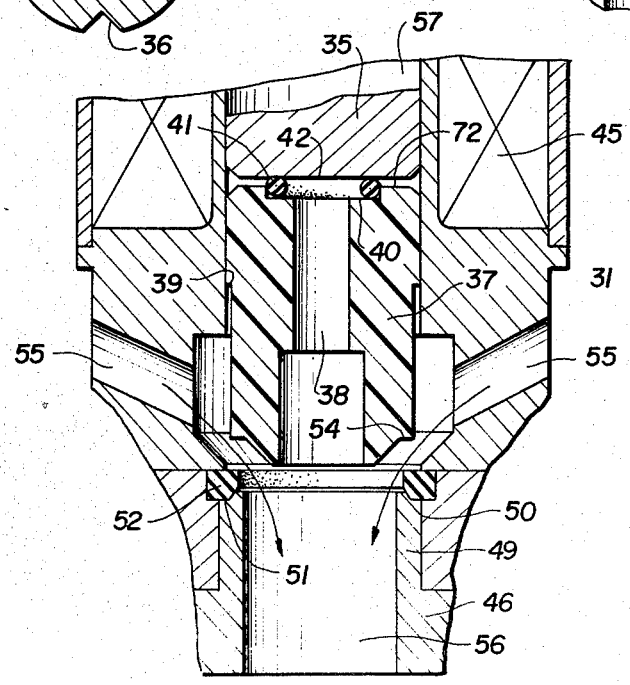
FIG.11

VALVE MODULE FOR DIGITAL COOLANT CONTROL SYSTEM

BACKGROUND OF THE INVENTION

This application discloses a number of important improvements in the construction of the valve modules employed in the digital coolant control system of U.S. Pat. No. 4,247,047.

While the coolant control system in the patent operates very efficiently in the accomplishment of the stated objectives of that invention, nevertheless, there are a number of drawbacks in connection with the manufacturing and field maintenance of the individual valve modules which the present invention addresses and completely overcomes. As a result, the present invention simplifies original assembly procedures and field maintenance and thereby significantly reduces manufacturing cost and the cost of maintenance.

More particularly, the valve modules in the above-referenced patent were hard wired by hand between the solenoid coils on each module and a common quick disconnect electrical terminal on the head of each module. This wiring was not only costly and laborious but repeated repair operations increased the likelihood of short circuits. In the patented structure, it was virtually impossible to replace a defective solenoid in the field and therefore the complete valve module had to be removed from the coolant header and either discarded or returned to the factory.

In the present invention, all hard wiring has been eliminated, and instead, a simple unitary printed circuit card sealed within the valve module head is electrically engaged by replaceable spring contact probes carried by each removable solenoid unit which can be readily removed in the field without necessitating the removal of the entire module from the header.

Another drawback in the patented structure was the use of a dynamic O-ring seal surrounding each solenoid valve control poppet. Certain fluids produced swelling of this seal to such an extent that the resulting friction retarded or disabled the operation of the valve poppet. To overcome this in the present invention, a unique magnetic-non magnetic two part poppet was devised having an interfacial O-ring seal, completely eliminating any dynamic seal surrounding the poppet and adversely effecting its operation. A very fast response time for the poppet is achieved as well as better valve shut-off characteristics due to the fact that system fluid pressure assists in closing the poppet against a provided elastic seal.

An additional major improvement provided in the present invention is the ready removability in the field of the poppet valve seal or seat held in the head of the module adjacent to each solenoid unit. In the prior patented structure, the entire valve module had to be removed from the coolant header and the solenoid had to be separated from the head of the module in order to remove the poppet seal or seat. With the present invention, a readily removable poppet seal retainer is provided which can be easily removed in the field with the poppet seal so that the latter can be replaced without disturbing the solenoid and without necessitating removal of the module from the coolant header. Once the seal retainer and seal are removed, the two poppet components are readily removable from the interior of the solenoid unit.

The above are the main improvement features provided in the present invention, and other features and advantages will be apparent to those skilled in the art during the course of the following description.

BRIEF DESCRIPTION OF THE DRAWINGS

FIG. 7 is a plan view of a printed circuit card.

FIG. 8 is a front elevation of a valve module head containing poppet seal retainers.

FIG. 9 is an enlarged cross section taken through a magnetic poppet component on line 9—9 of FIG. 5.

FIG. 10 is a perspective view, partly in section, showing a poppet seal retainer and seal assembly.

FIG. 11 is a cross sectional view similar to FIG. 5 showing the non magnetic poppet component displaced from the replaceable seal to open a pathway for coolant leading to coolant spray nozzles on the module.

DETAILED DESCRIPTION

Figure 1:
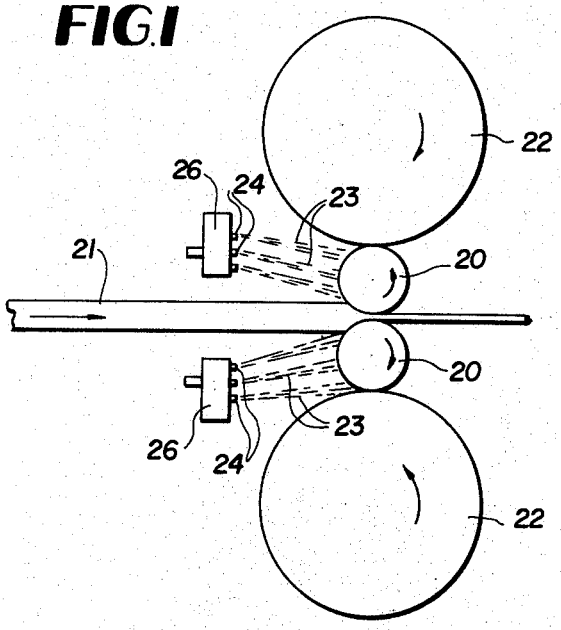
FIG. 1 is a schematic side elevation of a strip rolling mill having a modular digital coolant control system.

Referring to the drawings in detail wherein like numeral designate like parts, a typical strip rolling mill is shown schematically in FIG. 1 and includes reduction rolls 20 for a fast moving metal strip 21 and larger backup rolls 22 for the reduction rolls. Zoned digitally controlled liquid coolant sprays 23 are directed onto the backs of the reduction rolls 20 by spray nozzle tips 24 contained in valve modules 25 mounted on liquid coolant headers 26, fixedly mounted above and below the strip 21 somewhat rearwardly or upstream from the rolls 20 and 22. The arrangement shown in FIG. 1 is described in Patent No. 4,247,047 and the mode of operation for delivering coolant onto the rolls 20 remains exactly as described in the patent and need not be repeated herein for a proper understanding of this invention. As will soon become apparent, this invention is concerned solely with a number of key improvements in the construction of the individual valve modules 25 which render them easier and less expensive to manufacture and much more convenient and economical to service in the field. The improvements also render the coolant system more efficient and reliable in operation but do not alter the basic mode of operation described in Patent No. 4,247,047.

Continuing to refer to the drawings, each improved valve module 25 comprises a head plate 27 having a forward dovetail groove 28 adapted to receive a male dovetail retainer plate, not shown, for the coolant spray nozzle tips 24 in the manner shown in the referenced patent. A mounting plate 29 backs up the head plate 27 and is attached by additional screws, not shown, to the head plate and to the forward wall 30 of header 26 substantially as indicated in the prior patent.

The body 31 of each solenoid control valve is engaged in a recess 32 of mounting plate 29 and secured therein by further screws 33. An O-ring seal 34 is provided between mounting plate 29 and the wall 30 of header 26.

Each solenoid valve includes a cylindrical magnetic armature 35 having longitudinal V-grooves 36 formed in the opposite sides thereof for the passage of liquid, as will be further described. The armature 35 forms the upper component of a two part poppet valve including a non-magnetic cylindrical valve element 37 having a through bore 38 and a narrow external annular shoulder 39 against which fluid pressure may react. The interior end face of non-magnetic poppet valve element 37 has a shallow recess 40 containing an O-ring seal 41 adapted to sealingly engage the opposing end face 42 of the magnetic armature 35 at certain times. The two part poppet is biased toward a valve closing position by a compression spring 43 behind each armature 35 and contained within an axial recess 44 formed in the armature. An electrical solenoid coil 45 surrounds the armature 35, as indicated.

Figure 6:
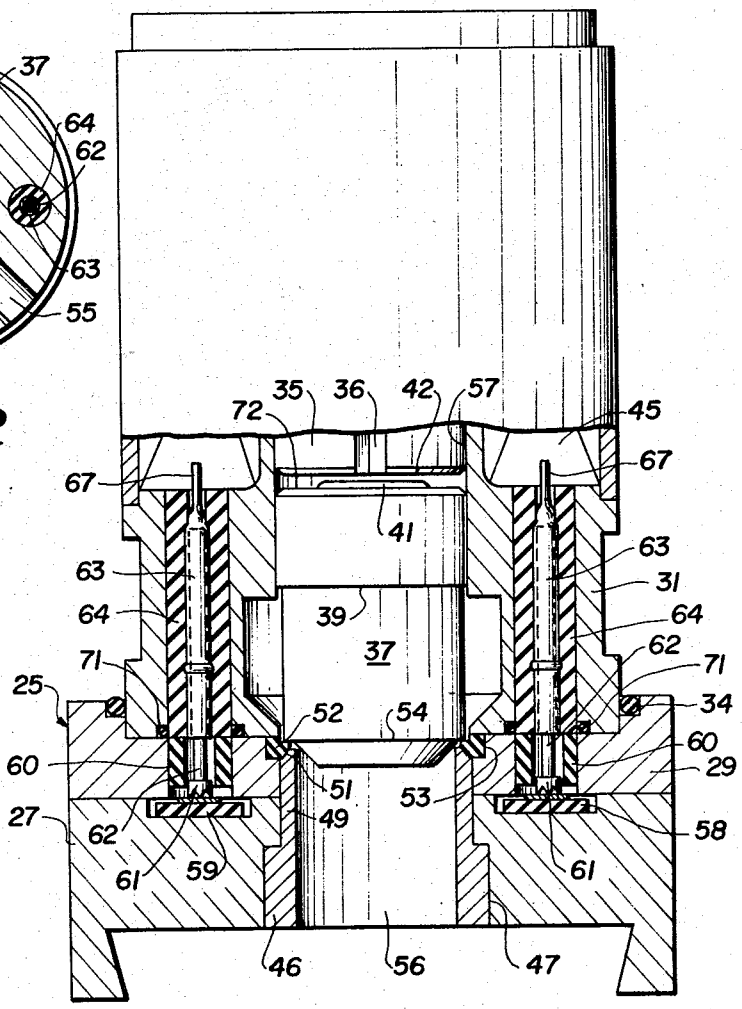
FIG. 6 is a similar cross section taken on line 6—6 of FIG. 4.
Figure 12:
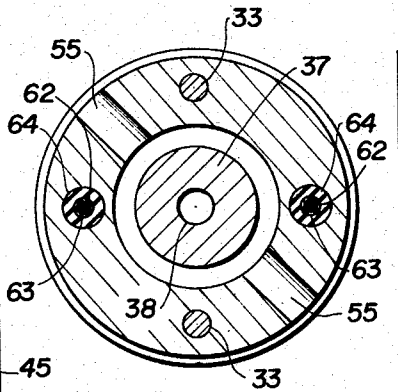
FIG. 12 is an enlarged cross section taken on line 12—12 of FIG. 5.
Figure 5:
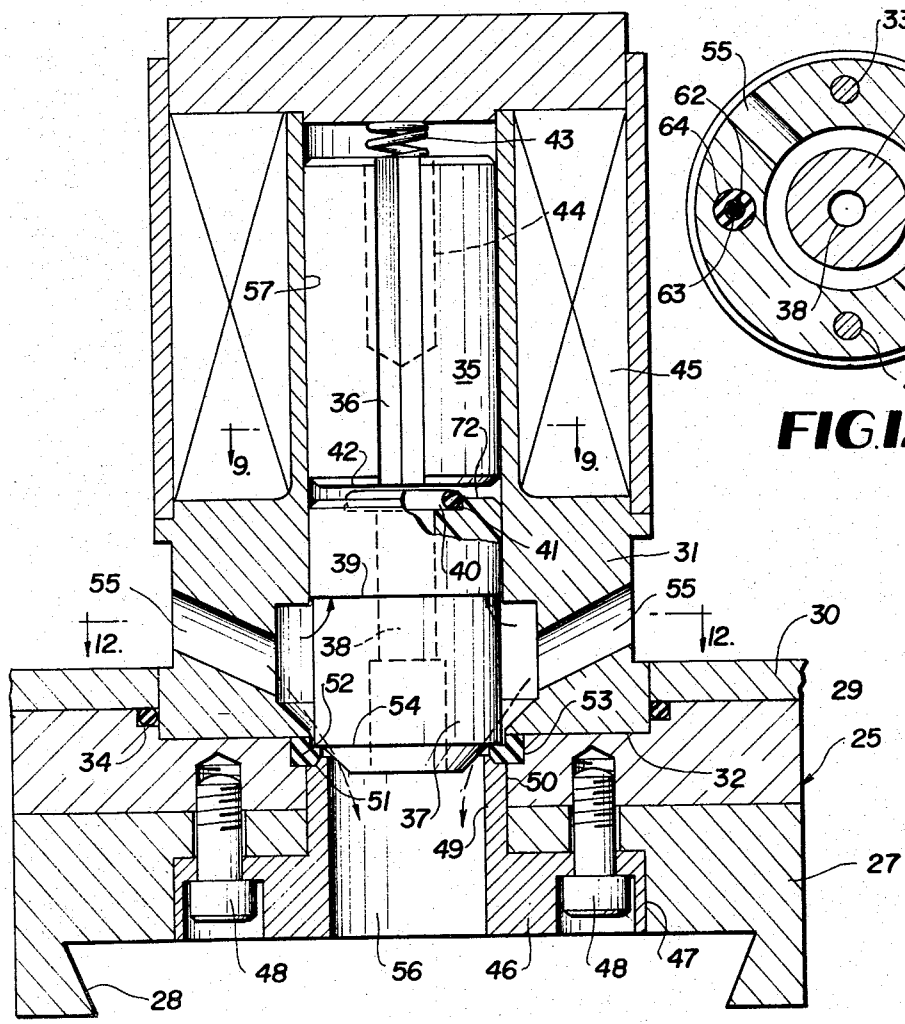
FIG. 5 is an enlarged cross section taken on line 5—5 of FIG. 4.

In accordance with a feature of the invention, a readily removable seal retainer 46 is held within a recess 47 of head plate 27 by screws 48. A cylindrical extension 49 of the retainer 46 projects into an opening 50 of the mounting plate 29 and includes an annular seat 51 for an elastomer poppet seal 52 which may be permanently bonded to the seat 51 so that the seal is removable as a unit with the retainer 46. The seal 52 engages in an annular recess 53 of the mounting plate 29, as shown. When the poppet valve is closed to shut off the flow of coolant to the spray nozzle tips 24, an annular shoulder 54 of the non-magnetic poppet element 37 engages and compresses the seal 52 as shown in FIGS. 5 and 6, FIG. 11 showing the uncompressed seal 52 when the poppet valve is open to place coolant ports 55 of each valve body 31 in communication with an outlet passage 56 through each retainer 46, FIG. 11. The outlet passages 56 deliver liquid coolant to the nozzle tips 24 at proper times in the manner described in the referenced patent.

When the seal retainer 46 and bonded seal 52 are removed as a unit, the poppet element 37 and armature 35 will slide freely out of the bore 57 of solenoid valve body 31. The solenoid body anchoring screws 33, when removed, allow the solenoid valve body 31 to be separated from the mounting plate 29 without the necessity of removing the latter from the header 26 and without disturbing the O-ring seal 34. In the prior art, the entire valve module 25 had to be removed from the header 26 in order to service the poppet seal and/or the solenoid valve itself.

In a further aspect of the invention which eliminates all hard wiring in the head portion of the valve module 25 composed of the two plates 27 and 29, a solid state prefabricated thin printed circuit card 58 is received in a shallow recess 59 of head plate 27 and permanently sealed and locked in place between the two plates 27 and 29 by epoxy resin.

Figure 4:
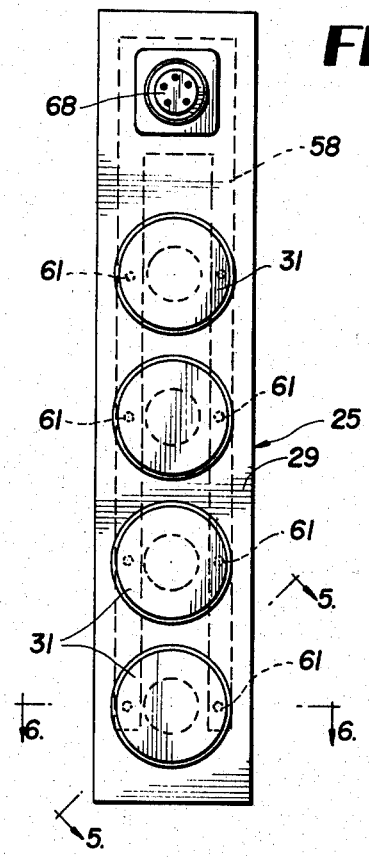
FIG. 4 is a rear elevation thereof.
Figure 2:
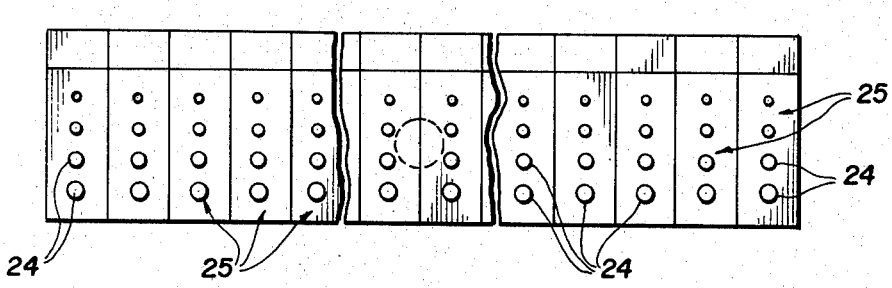
FIG. 2 is a partly schematic front elevation of multiple valve modules on a common coolant header.
Figure 3:
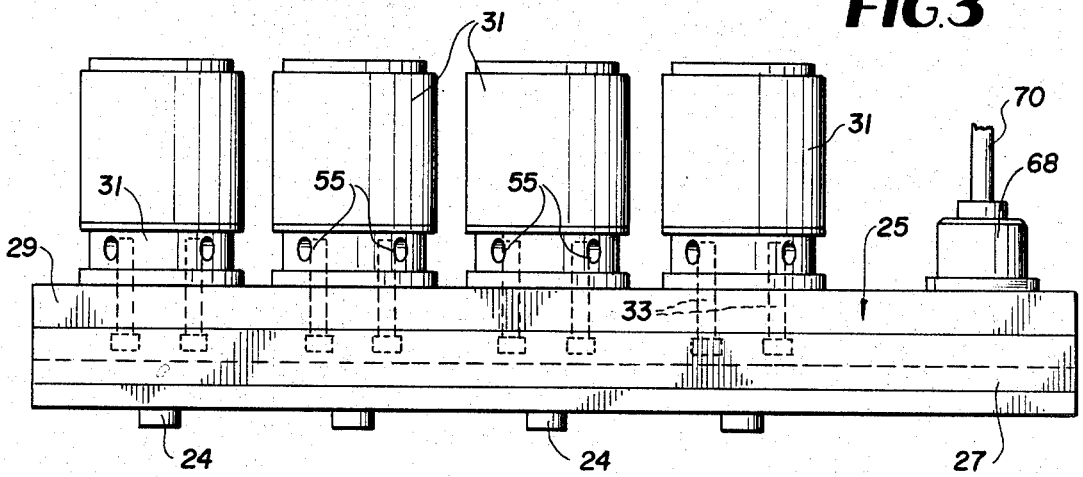
FIG. 3 is a side elevation of one valve module.

Insulating sleeves 60 are fixed within openings of the mounting plate 29 and guidingly receive the toothed heads 61 of replaceable spring contact probes 62 whose outer shells 63 are permanently held in insulating sleeves 64 fixed in openings of the solenoid valve bodies 31. The contact heads 61 are spring-urged into electrical engagement with the metallic conducting strips 65 on the card 58 at the points 66, **66*a*, 66*b* and 66*c*, FIG. 7. As shown in FIGS. 3 and 4, there may be up to four solenoid valves 31 on each module 25 and their pairs of spring contact probes 62 complete circuits on the printed circuit card 58 across the respective points 66 through 66*c*, one separate circuit for each valve. The shells 63 of the replaceable spring contact probes 62 are electrically connected through terminals 67 with the individual solenoid coils 45. A common quick disconnect electrical receptacle 68 on each mounting plate 29 has its terminals electrically engaged with conducting terminals 69 on the printed circuit card 58 to establish valve control circuit through a cable 70, as disclosed in the referenced patent. In essence, instead of the internal hard wiring of the prior art, the above-described electrical arrangement makes possible easy separation of a defective solenoid body 31 from the module 25 without separating the module from the coolant header 26. It also renders replacement of a defective spring contact probe 62 very convenient. O-ring seals 71 are provided in surrounding relationship to the insulating sleeves 64 at the opposing surfaces of mounting plate 29 and valve bodies 31, FIG. 6**. These seals plus the epoxy sealing of the printed circuit card in place completely isolate the electrical components from fluid in accordance with a major advantage of the invention.

In connection with the operation of the dual component solenoid poppet valves, the following takes place. When the solenoid coil 45 of each valve is de-energized by remote control as explained in the referenced patent, the return spring 43 will urge the two part poppet toward the soft seal 52 to close the valve and block the flow of coolant from the interior of the header 26 through the ports 55 and passage 56 to the coolant nozzle tips 24. In addition to spring action, fluid will flow through the bore 57 around the peripheries of the non-magnetic poppet 37 and magnetic armature 35 to the rear end of the armature adjacent to the spring 43 and the resulting fluid pressure will assist in closing the valve. In the prior art, the spring alone was relied upon to close the valve and there was also the retarding effect of a dynamic O-ring around the poppet or armature which could actually disable the valve if too much swelling of the O-ring occurred. This dynamic seal is entirely eliminated in the present invention and a very fast valve response time and much better closing characteristics are achieved.

When the coil 45 is energized to retract the armature 35 and compress the spring 43 to open the valve and admit coolant to the nozzle tips 24 as shown in FIG. 11, the following action takes place. The pressurized liquid coolant will act on the narrow shoulder 39 of non-magnetic poppet element 37 tending to lift this element from the seal 52. The same liquid will flow past the periphery of poppet element 37 in the bore 57 and will act on the interior end face 72 of element 37, tending to oppose unseating of this element. However, due to the pressure drop in the fluid acting on the end face 72, the net force of the fluid acting on the shoulder 39 will be greater and will lift the element 37 from the seal 52 to the open position shown in FIG. 11 where the O-ring 41 is engaged with the end face 42 of the armature 35. FIGS. 5 and 6 show a slight space between the seal 41 and end face 42, which space will exist for only a few milliseconds after the armature retracts and before the movement of the non-magnetic element 37 away from the seal 52 under influence of net fluid pressure takes place. Therefore, it may be seen that fluid pressure assists the spring 43 in closing the two part poppet valve against the seal 52 and assists in moving the non-magnetic element 37 off of the seal 52 almost instantaneously after energizing each coil 45. A much improved valve action is obtained without the stated drawbacks of the prior art.

When fluid passes the space behind the armature 35 to assist in closing the valve as described, such fluid can return through the grooves 36 in a continuous circulation mode.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a valve module for a coolant system or the like, a head structure adapted for sealed attachment to a header, plural remotely controlled solenoid valves on the head structure, a single electrical receptacle common to the plural valves on the head structure, a printed circuit element common to the valves in the head structure and having electrical terminals adapted for connection with terminals of said receptacle on the head structure and having conducting strips defining separate circuits for said valves leading from the terminals of the printed circuit element, and each solenoid valve of the valve module having a pair of spring contacts connected with the coil of the valve and being biased into electrical engagement with terminal points on said conducting strips defining said separate circuits on the printed circuit element.

2. In a valve module as defined in claim 1, and said spring contacts being replaceably held in shells which are electrically connected to said coil and are permanently held in insulating sleeves of each solenoid valve.

3. In a valve module as defined in claim 1, and each solenoid valve having a magnetic-non magnetic two part poppet, an elastic seal for engagement with the non magnetic poppet part within the head structure, and a retainer for the elastic seal detachably connected with the head structure and enabling removal of said seal and the two part poppet from the body of each valve without separating the body from the head structure.

4. In a valve module as defined in claim 3, and the elastic seal being bonded to said retainer for separation therewith as a unit from the head structure.

5. In a valve module as defined in claim 3, and the head structure comprising a dovetail head plate adapted to support a mating dovetail nozzle tip retainer, and a mounting plate for said solenoid valve adapted for attachment to a header and defining with said head plate a closed chamber for the printed circuit element in which the latter can be sealed with epoxy resin or the like.

6. In a valve module as defined in claim 3, and each valve having a spring therein engaging and biasing the two part poppet toward the elastic seal.

7. In a valve module as defined in claim 6, and each valve having a poppet receiving bore coaxial with said elastic seal and retainer and said bore allowing fluid under pressure from a header to which the module is attached to flow around the two parts of the poppet to the rear end of the poppet to assist said spring in urging the two part poppet into engagement with the elastic seal, the magnetic part of the poppet having at least one external return flow groove for said fluid and the non magnetic part of the poppet having a through bore, and an O-ring on the end face of the non magnetic part of the poppet which is opposed to one end face of the magnetic part and adapted to engage said one end face on a circle disposed radially inwardly of said groove.

8. In a valve module as defined in claim 3, and the non magnetic part of the poppet having an annular shoulder against which pressurized fluid may react tending to move the non magnetic part of the poppet away from the elastic seal.

9. In a valve module as defined in claim 7, and the non magnetic part of the poppet having an annular shoulder against which pressurized fluid may react tending to move the non magnetic part of the poppet away from the elastic seal.

10. In a valve module as defined in claim 1, and means detachably securing said valves on said head structure and enabling separation of the bodies of individual valves from the head structure.

11. In a valve module as defined in claim 3, and each retainer being held by screws in assembled relationship with the head structure and each retainer defining an outlet fluid passage for delivering coolant or other fluid to nozzle tips when the two part poppet is separated from the elastic seal.

12. In a valve module as defined in claim 2, and interfacial ring seals between the end faces of each solenoid valve and the opposing face of said head structure surrounding said insulating sleeves.

* * * * *